US005146695A

United States Patent [19]

Yang

[11] Patent Number: 5,146,695

[45] Date of Patent: Sep. 15, 1992

[54] HAND OR HAIR DRYER

[76] Inventor: Tai-Her Yang, 5-1 Taipin St., Si-Hu Town, Dzan-Hwa, Taiwan

[21] Appl. No.: 616,434

[22] Filed: Nov. 21, 1990

[51] Int. Cl.[5] ..... F26B 19/00

[52] U.S. Cl. ..... 34/90; 34/202; 34/97; 392/380; 392/381

[58] Field of Search ..... 34/90, 91, 96, 97, 243 R, 34/201, 202; 392/379, 380, 381, 383, 384, 385

[56] References Cited

U.S. PATENT DOCUMENTS

| | | | |
|---|---|---|---|
| 1,750,094 | 3/1930 | Emmrich | 34/243 R |
| 2,314,101 | 3/1943 | Phipps | 34/90 |
| 2,761,222 | 9/1956 | Bennett | 34/202 |
| 3,305,938 | 2/1967 | Goldstein | 34/90 |
| 3,643,346 | 2/1972 | Lester | 34/202 |
| 3,667,134 | 6/1972 | Rockson | 34/202 |
| 4,336,619 | 6/1982 | Hinkel et al. | 34/90 |

*Primary Examiner*—Henry A. Bennett
*Assistant Examiner*—Denise L. F. Gramada
*Attorney, Agent, or Firm*—Leonard Bloom

[57] ABSTRACT

A wall-mounted hand dryer incorporates a cowl (109) which is mounted on the underside of its cabinet (108) so that the mouth (112) of the cowl extends forwardly beyond the lower edge of the front face of the cabinet, on which an air outlet (106) is mounted. In use, hot air expelled from air outlet flows over the users hands (not shown) and a large proportion of the waste air is collected by cowl (109) and is directed to apertures in the underside of the cabinet (not shown) so that a closed path is formed which enables the air to recirculate. A correspondingly lower power electric heating element may be used, which alleviates the problem of electrical overload caused by a number of such hand dryers operating simultaneously.

4 Claims, 3 Drawing Sheets

HAND OR HAIR DRYER

The present invention relates particularly to a hand dryer but is also applicable to hair dryers. Wall-mounted hand dryers are commonly installed in public conveniences. Since they incorporate a high power electric heating element they consume considerable power (typically 1.5KW of more) and if a number of such dryers are used simultaneously, there is a danger that the mains circuit will be overloaded. Furthermore, the high power heating element requires switches having a correspondingly high current capacity which increase the cost of the appliance.

In general, known hand and hair dryers have an air inlet, an air outlet, means for drawing air in through the air inlet and expelling said air from the air outlet and means for heating the air that is drawn in through the air inlet.

According to the present invention a hand or hair dryer is characterised in that the air inlet is located in the path of the air expelled from the air outlet whereby in use, at least some of the hot air that is expelled from the air outlet is subsequently drawn in through the air inlet.

Preferably the mouth of the air inlet faces the mouth of the air outlet.

Further preferred features are defined in the appended claims.

The invention has the advantage that the air drawn in through the air inlet has a significantly high temperature than if none of the expelled hot air were recovered, and accordingly requires less heating. Thus the power of the heating element may be less than in prior art dryers.

A preferred embodiment of the invention is described below by way of example only with reference to FIGS. 1 to 6 of the accompanying drawings, of which:

Figure 1:
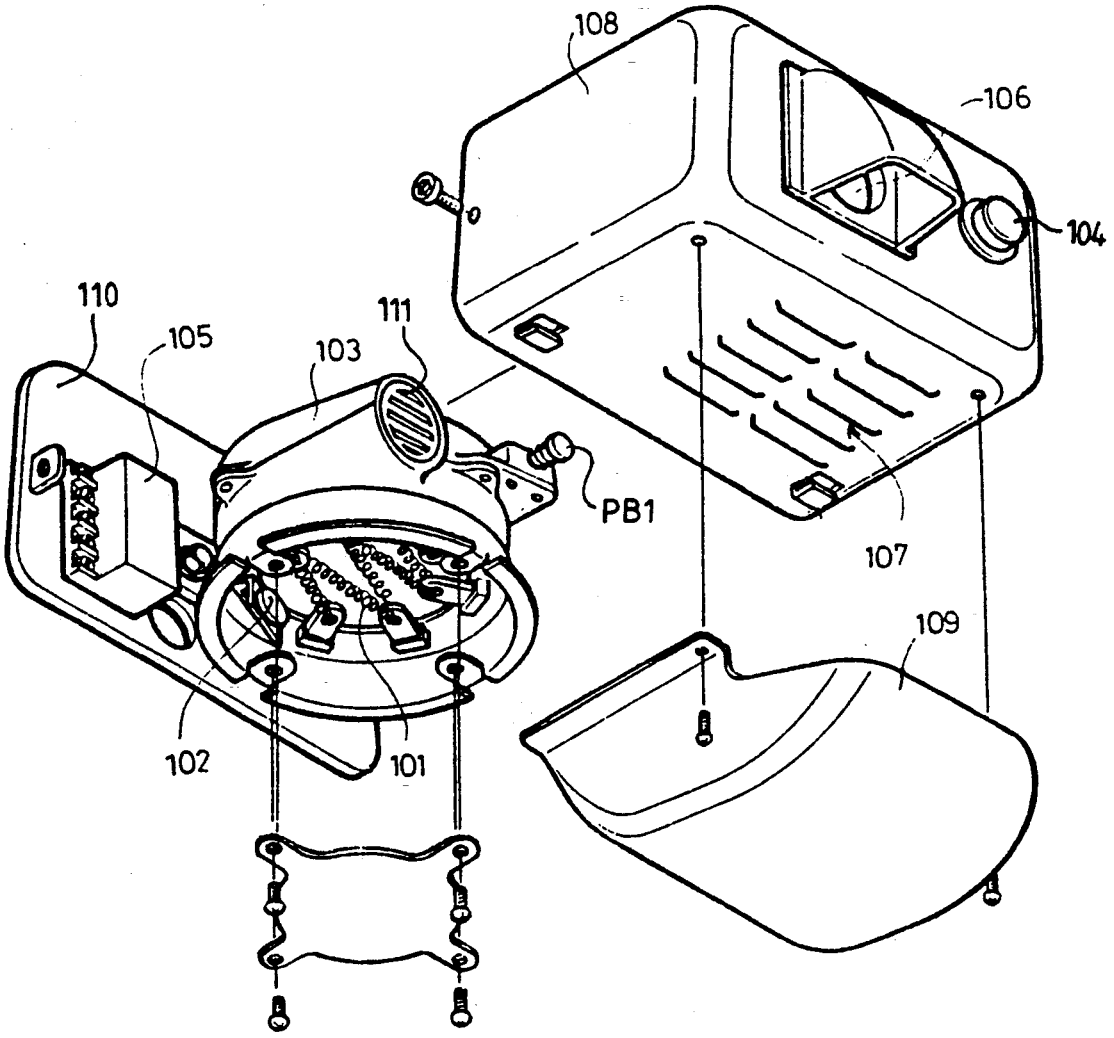
FIG. 1 is an exploded view showing the parts of a dryer in accordance with the invention.
Figure 3:
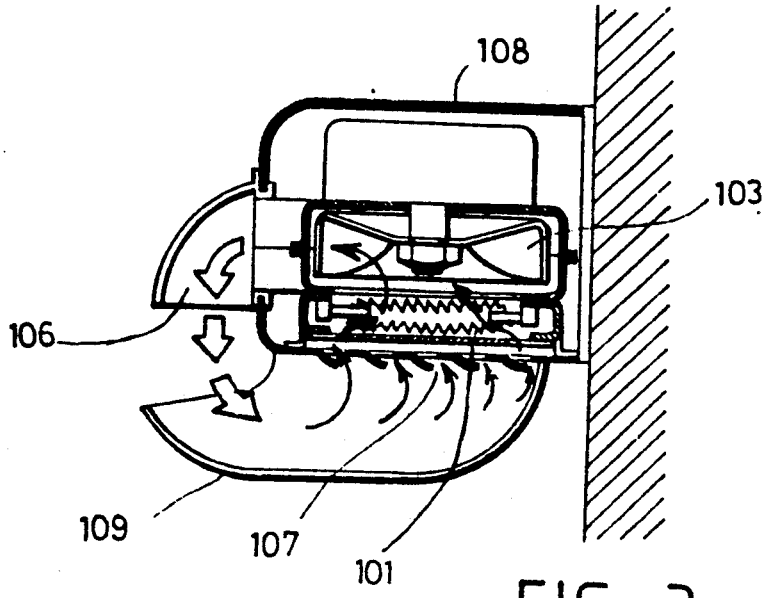
FIG. 3 is a sectional side elevation showing the dryer of Figure two mounted on a wall.
Figure 4:
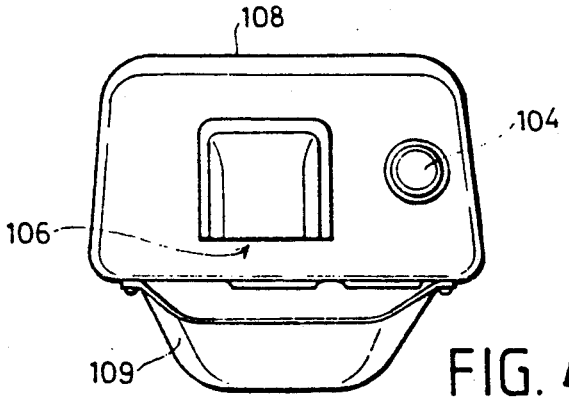
FIG. 4 is a front view of the dryer.
Figure 5:
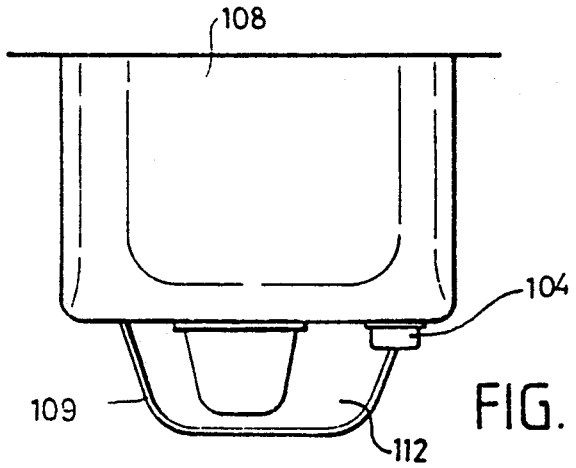
FIG. 5 is a top view of the dryer.

Referring to FIG. 1, it will be seen that the dryer comprises a cabinet 108 which accommodates a fan unit 103 and is arranged to be mounted on a wall-mounted plate 110. Fan unit 103 includes a grid 111 and incorporates a mains heating element 101 which is located upstream of a motor-driven fan as shown in FIG. 3 As shown in FIG. 3, the underside of cabinet 108 has two rows of slots 107 which are aligned with the heating element 101 and constitute air inlet apertures. As shown in FIG. 1, fan unit 103 has an outlet portion 111 which is aligned with an air outlet 106 which is mounted on the front of cabinet 108.

The hand dryer is operated by a press switch 104 which engages a push button PBl which projects from the fan unit 103.

The hot air expelled from air outlet 106 is temperature-controlled by a temperature-regulating device 102 and the duration of the hot air flow is controlled by timing circuitry 105.

Figure 2:
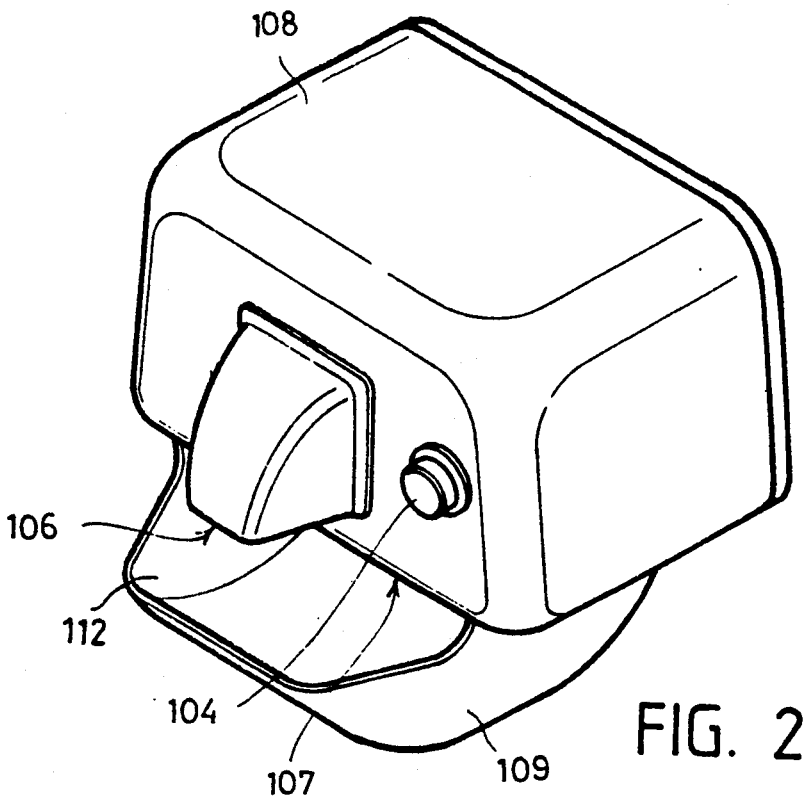
FIG. 2 is a sketch perspective view of the dryer.

As described thus far, the hand dryer is entirely conventional. However, in accordance with the invention, a cowl 109 is screwed to the underside of cabinet 108, and, as best seen in FIG. 2, incorporates a mouth portion which extends beyond the lower edge of the front face of the cabinet so as to face the mouth of air outlet 106. Since the mouth of the cowl 109 is substantially larger than the mouth of air outlet 106, a substantial proportion of the air expelled from the air outlet is drawn back into the dryer via mouth 112, as can be seen from FIG. 3.

Although the cowl 109 is shown as a separate detachable member (so that it can be used to modify existing hand or hair dryers for example), it is envisaged that cowl 109 may alternatively be an intergal part of cabinet 108. Also it is envisaged that switch 104 and push button PBl may be replaced by an ultrasonic, infra-red or other remote sensor which turns on the dryer in response to a user placing his hand in the path of air outlet 106.

Figure 6:
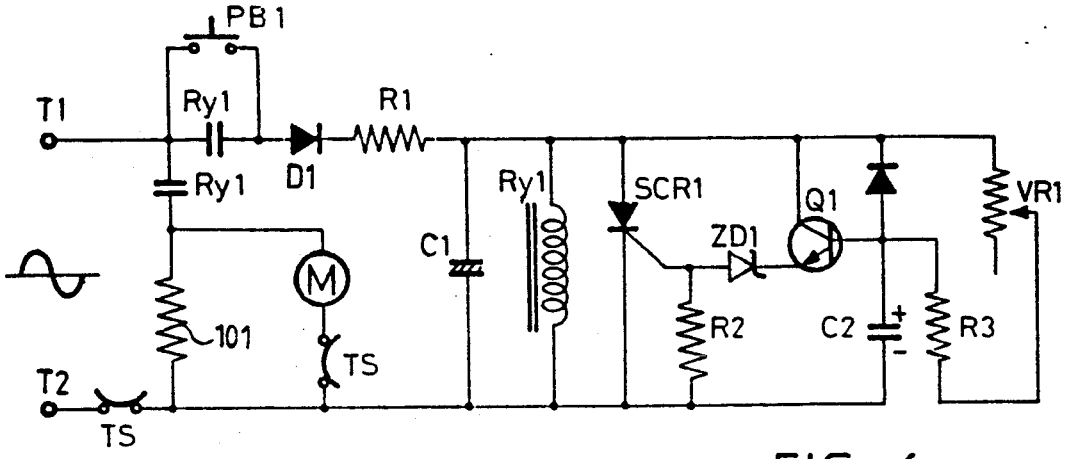
FIG. 6 is a simplified circuit diagram showing the electrical circuitry of the dryer.

The fan and heater of the dryer are controlled by the circuitry shown FIG. 6 as follows Mains power is connected across terminals T1 and T2 and is initially isolated from the parallel combination of electric heating element 101 and fan motor M by one of two normally open pairs of relay contacts Ryl. However when press switch 104 (FIG. 1) is pushed so to close push button PBl, one pair of open relay contacts is by passed to allow a current to flow through a rectifying diode D1 and resistor R1 to the winding of relay Ryl. Accordingly the relay contacts Ryl in parallel with the contacts of switch PBl latch shut and relay Ryl remains energized. A reservoir capacitor C1 is connected across the terminals of this winding The current flowing from diode D1 and resistor R1 also flows via a variable resistor VR1 and a fixed resistor R3 to the base of a transistor Q1 at its junction with a storage capacitor C2. Accordingly, capacitor C2 charges gradually at a rate determined by the RC time constant of the current and after a predetermined period its charge rises to a level sufficient to cause transistor Q1 to fire a silicon-controlled rectifier SCR1 via a Zener diode ZD1. A resistor R2 is connected between terminal T2 and the junction of SCR1 and ZD1. When silicon-controlled rectifier SCR1 fires, current from resistor R1 flowing into relay winding Ryl is by-passed and the current through relay winding Ryl falls to zero, causing both sets of relay contacts Ryl to open and then to switch off heating element 101 and motor M until push button PBl is closed again by pressing switch 104.

It should be noted that although the invention is particularly applicable to wall-mounted hand dryers, it is not limited there to. In particular, the invention is applicable to hair dryers.

I claim:

1. A hand or hair dryer having an air inlet, an air outlet, means for drawing air in through the air inlet and expelling said air from the air outlet and means for heating the air that is drawn in through the air inlet, the device comprising the air inlet including a cowl, the cowl having a mouth being located in the path of the air expelled from the air outlet, such that at least a portion of the hot air expelled from the air outlet is received in the mouth of the cowl, the cowl further formed so that hot air received in the mouth of the cowl is directed to the air inlet, whereby in use, at least some of the hot air expelled from the air outlet is subsequently drawn in through the air inlet, the mouth of the cowl being substantially larger than the air outlet, such that a substantial portion of the hot air expelled from the air outlet is received in the mouth of the cowl, further comprising a cabinet having the air outlet mounted on the exterior of one wall portion and having at least one inlet aperture formed in an adjacent wall portion of the cabinet, the dryer further comprising said air inlet includes the cowl being mounted on the exterior of said adjacent wall portion, so as to cover said at least one inlet aperture, the cowl having an external opening which faces the mouth of the air outlet, wherein the wall portions are transverse to each other and the mouth of the cowl extends beyond the common boundary region of said wall portions.

2. A dryer as claimed in claim 1, wherein the air outlet is located on a front wall of the cabinet, and the cowl is mounted on the underside of the cabinet.

3. A dryer as claimed in claim 1, wherein the cowl is detachably mounted on the exterior of the cabinet.

4. A dryer as claimed in claim 1, which includes means for mounting the dryer on the wall of a building.

* * * * *